US005671896A

United States Patent [19]

Jäggi

[11] Patent Number: 5,671,896

[45] Date of Patent: Sep. 30, 1997

[54] APPARATUS FOR THE REELING UP AND UNREELING OF FLAT PRINTED PRODUCTS

[75] Inventor: Urs Jäggi, Härkingen, Switzerland

[73] Assignee: GRAPHA-Holding AG, Hergiswil, Switzerland

[21] Appl. No.: 525,093

[22] Filed: Sep. 8, 1995

[30] Foreign Application Priority Data

Sep. 14, 1994 [CH] Switzerland ..... 02795/94

[51] Int. Cl.[6] ..... B65H 39/14; B65H 63/04

[52] U.S. Cl. ..... 242/528; 53/118; 53/430

[58] Field of Search ..... 242/528; 53/430, 53/118

[56] References Cited

U.S. PATENT DOCUMENTS

| | | | |
|---|---|---|---|
| 4,569,488 | 2/1986 | Baltisberger | 242/528 |
| 4,768,768 | 9/1988 | Reist | 242/528 X |
| 5,400,567 | 3/1995 | Lindstrand | 53/430 X |

FOREIGN PATENT DOCUMENTS

| | | |
|---|---|---|
| 0498962 | 8/1992 | European Pat. Off. . |
| 3602320 | 8/1986 | Germany . |
| 559691 | 3/1975 | Switzerland . |
| 2140785 | 12/1984 | United Kingdom . |

*Primary Examiner*—John Q. Nguyen
*Attorney, Agent, or Firm*—Spencer & Frank

[57] ABSTRACT

An apparatus for reeling up and unreeling of flat printed products onto and from, respectively, a reel core. The reel core has a horizontal reel axis and is fixedly arranged in a reel stand to form one piece so that the reel stand and reel core can be driven together about the horizontal reel axis. A reeling strap mandrel is detachably seated in the reel stand and has a horizontal axis that is parallel with the rotational axis of the reel core. A reeling strap is wound on the reeling strap mandrel and has one end connected to the reel core and a second end connected to the reel mandrel. The reeling strap rolls off the reeling strap mandrel and is fed to the reel core in an undershot manner for forming reeled layers of printed product on the reel core.

15 Claims, 2 Drawing Sheets

APPARATUS FOR THE REELING UP AND UNREELING OF FLAT PRINTED PRODUCTS

CROSS-REFERENCE TO RELATED APPLICATION

This application claims the priority of Patent Application Serial No. CH 02 795/94-0 filed in Switzerland on Sep. 14, 1994, the subject matter of which is incorporated herein by reference.

BACKGROUND OF THE INVENTION

The invention relates to an apparatus for the reeling up and unreeling of flat printed products onto and from, respectively, a reel core arranged in a frame, to which core, for the formation of reeled layers of the printed products, at least one reeling strap is allocated which can be rolled off a reeling strap mandrel and is fed to the reel core in an undershot manner.

An apparatus of the above type for the further processing of printed products is known in the industry and is sold by the Müller Martini Group under the name PrintRoll-System. This apparatus can accommodate the demand for shorter pass times in the printing of newspapers, brochures and other printed products or for high production outputs. It is also the key to fully automated further processing. Therefore, such an apparatus can be integrated into production lines for gathering and wire stitching, perfect binding, thread stitching and inserting. It may also be connected upstream or downstream of cutting, folding and addressing devices.

In the interest of a cost efficient application, the PrintRoll-System requires that the frame, the reel core (which can be driven in the frame), and the reeling strap or the strap magazine, form a unit which is inseparable with regard to use, which unit can be moved by a lifting mechanism and used at different processing points.

Independent of the PrintRoll-System, there exists the principle of separating the reel or the reel core together with the reeling strap from a frame on the assumption that a unit which, as described above, is burdened with high acquisition costs, supposedly takes up more storage space. But the application of a solution wherein the reel core can separated from and taken out of the frame presents a number of difficulties or uncertainties. For example, a product-protecting storage of the reel is not ensured, i.e., damaged products lead to interruptions during processing. Further, before the products are reeled up or unreeled, the reeling strap must be clamped in at the reel core or at the reeling strap mandrel of the strap magazine. Partially filled reels must be freed from the superfluous strap windings prior to unreeling the products and, vice versa, superfluous strap windings are needed before the reel is separated from the frame. Moreover, the reels are susceptible to damage during transport by truck, stackers or other transport devices.

SUMMARY OF THE INVENTION

Therefore, in addition to the above-referenced advantages of the PrintRoll-System, it is an object of the invention to maintain the optimum mobility of the system in creating an apparatus of the type mentioned in the introduction and to additionally take into account lower acquisition costs.

The above and other objects are accomplished in accordance with the invention, by the provision of an apparatus for reeling up and unreeling of flat printed products onto and from, respectively, a reel core, comprising: a reel stand; a reel core having a horizontal reel axis and being fixedly arranged in the reel stand to form one piece so that the reel stand and reel core can be driven together about the horizontal reel axis; a reeling strap mandrel detachably seated in the reel stand and having a rotational axis that is parallel with the reel axis of the reel core; and a reeling strap wound on the reeling strap mandrel and having one end connected to the reel core and a second end connected to the reeling strap mandrel, the reeling strap being rollable off the reeling strap mandrel and fed to the reel core in an undershot manner for forming reeled layers of printed products on the reel core.

In this manner, the demands listed above can be met and an apparatus for the reeling up and unreeling of flat printed products having smaller dimensions and lower construction weights can be created.

In a preferred embodiment, the reel stand is formed by two side walls which are at a lateral distance from one another and which receive the reel core.

In a particularly advantageous embodiment, the side walls of the reel stand form the hub of the reel core, i.e., the side walls extend to the front faces of the reel core and lend themselves as rotary drive for the reel core.

Advantageously, the reel stand ends at the upper radius of the cylindrical reel core so that, advisably, a connection between reel core and reel stand can be effected through welding.

For the filling of unused spaces in the reel stand, the bearing which receives the reeling strap mandrel of the reeling strap is disposed in a lower lateral region of the reel stand so that contact with the installation surface or the floor and the reel does not take place when the reeling strap is rolled up. The free space disposed laterally of the vertical plane extending through the rotary axis is suitable for this purpose.

According to a further feature of the invention, a simple seating is formed by slot-like recesses, open on one end, which allow a fast disassembly of the reeling strap mandrel or of the reeling strap which is rolled up on the reeling strap mandrel.

For the reeling up or unreeling of the printed products it is necessary to lift the reel stand and reel core off the floor. For this purpose the reel stand is advantageously provided with a rotary coupling element of an associated lifting device.

To this end, a coupling element of a coupling device is arranged in the rotary axis of the reel core and is connected with the latter or with the hub.

In order to be able to maintain the apparatus in a specific position or to turn it during a move from the unreeling to the reeling-up position and vice versa, the coupling device is preferably provided with a turning stop device which can be switched in.

The moving of the apparatus advisably takes place by a lifting device having swing arms which act laterally upon the reel stand and which can be actuated by a pressure medium.

The preferred embodiment of the apparatus allows the reel core to be driven at its reel axis or tangentially at the circumference of the reel.

For transport across the floor, the reel stand advantageously is configured with a transport device or adapter device which faces the floor.

For the reception of reels which are larger than originally intended, the reel stand is configured for connection with a base on the side facing the floor, which base can be placed underneath.

These and other features and advantages of the invention will be further understood from the following detailed description of the preferred embodiments with reference to the accompanying drawings.

DETAILED DESCRIPTION OF THE PREFERRED EMBODIMENTS

Figure 2:
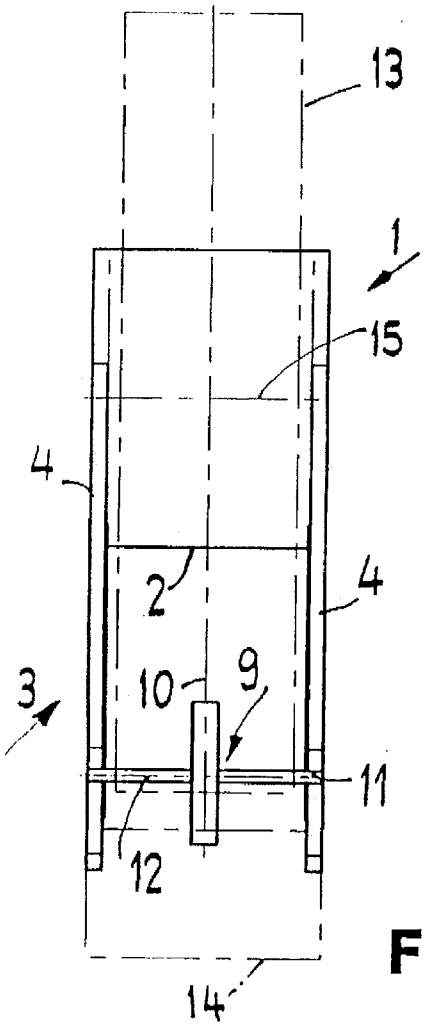
FIG. 2 is an end view of the apparatus according to FIG. 1.
Figure 1:
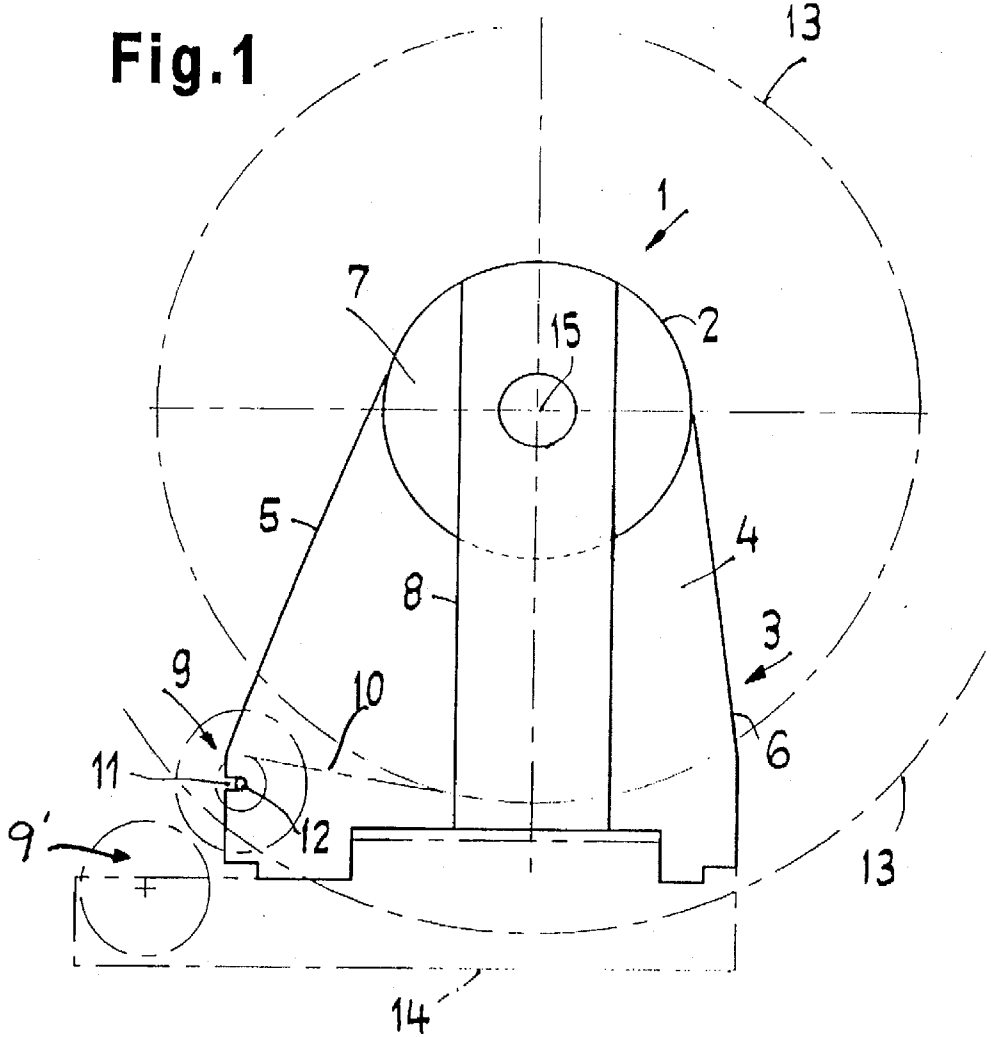
FIG. 1 is a side view of an apparatus according to the invention.

Referring to FIGS. 1 and 2, there is shown an embodiment of an apparatus 1 employing the principles of the invention. Apparatus 1 provides for rotative reeling up and unreeling of flat printed products onto and from, respectively, a reel core 2 which is arranged in a reel stand 3. Reel core 2 and reel stand 3 are connected with one another by means of welding seams to form one piece. As shown in the figures, reel core 2 rests with a portion of its circumference and at its lateral edges on two side walls 4 which are at a lateral distance from one another. For this purpose, side walls 4 are recessed at their upper edge approximately in a semicircular shape and their lateral edges 5, 6 extend at one end tangentially to reel core 2 and at the opposite end trail towards the floor while widening side walls 4, thus improving the stability of reel stand 3.

In an alternative embodiment which is not shown, lateral side walls 4 form a hub 7 of reel core 2, if they are adapted in the upper region approximately to the radius of reel core 2 which extends upwards. In such an embodiment, reel core 2 would be arranged between the lateral side walls 4 and be connected to the latter through welding seams.

Furthermore, FIG. 1 indicates a perpendicularly extending reinforcement sheet metal piece 8 which improves the rigidity of reel stand 3 and the seating of the apparatus. The connection between reel core 2 and reel stand 3 through known means is within the knowledge of a person skilled in the art. Reel core 2 may remain at least partially open at the front faces or be configured so as to be closed.

FIGS. 1 and 2 additionally show an arrangement of a reeling strap mandrel 9 for a reeling strap 10, which strap is utilized for formation of the reeled up layers of printed products at reel core 2. Reeling strap 10 is shown being fed in an undershot manner to reel core 2 or the reel which is to be formed of printed products. At its ends, reeling strap 10 is respectively connected to reeling strap mandrel 9 and reel core 2, and is stretched between these two elements. This is a known technique, and the stretching of reeling strap 10 may take place in different ways which are known in the prior art, such as by a drive device acting upon reeling strap mandrel 9, which device is neither described in detail nor illustrated in the drawings.

Reeling strap mandrel 9 is detachably seated in a simple manner in reel stand 3 or in side walls 4, for which purpose a guiding slot or a slot-shaped recess 11 is provided, which is accessible from one side. Reeling strap mandrel 9 has a shaft 12 which may be inserted, for example, into the two guiding slots 11 distributed over the side walls 4, so that it may be fixed in place and removed again, with the object of this being explained in greater detail in conjunction with FIG. 3. The seating of the reeling strap mandrel 9 in the lower side region of reel stand 3 is connected to the way in which apparatus 1 is used during the reeling up or unreeling process, the latter being illustrated in FIG. 3.

In FIGS. 1 and 2, a reel 13 formed of printed products is shown by dot-dash lines. For the production of reels 13 which are larger than originally intended, an adaptable base 14 can be placed under reel stand 3, which base is embodied with a receiving device for a lifting truck, stacker truck or crane, etc., in the same manner as reel stand 3. Naturally, base 14 may also be configured with the option of a special seating of the reeling strap mandrel, as denoted by reference numeral 9'.

The rotary driving of reel core 2 on reel axis 15 and of apparatus 1, according to the invention, takes place after apparatus 1 has been lifted off the ground so that the longest lateral edge 5, 6 of the reel stand 3 can turn freely above the ground.

Apparatus 1, which is mainly comprised of reel stand 3 and reel core 2, can be placed into a suspended position by means of a lifting device 16, with apparatus 1 in this position being held at reel axis 15 so that its rotary movement can take place. To this end, apparatus 1 is provided at reel axis 15 with a coupling element 17 of a rotary connection not fully shown in the drawing, which rotary connection makes it possible to initiate the turning of apparatus 1 and reel core 2 in the suspended position, for example, via hub 7. Another coupling element could then be arranged in lifting device 16. In order to keep apparatus 1 in a special turning position as needed, the rotary connection is desirably provided with a turning stop device (not shown) which can be switched in.

Figure 3:
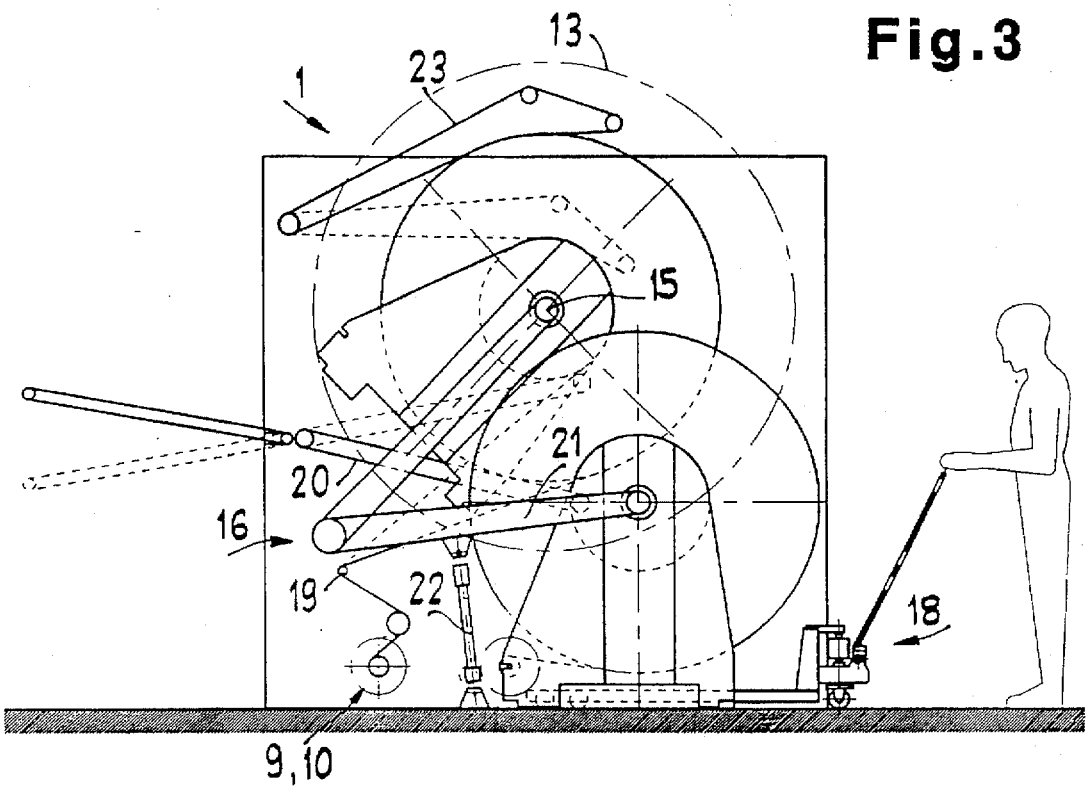
FIG. 3 is a side view of the apparatus at a roll-off station.
Figure 4:
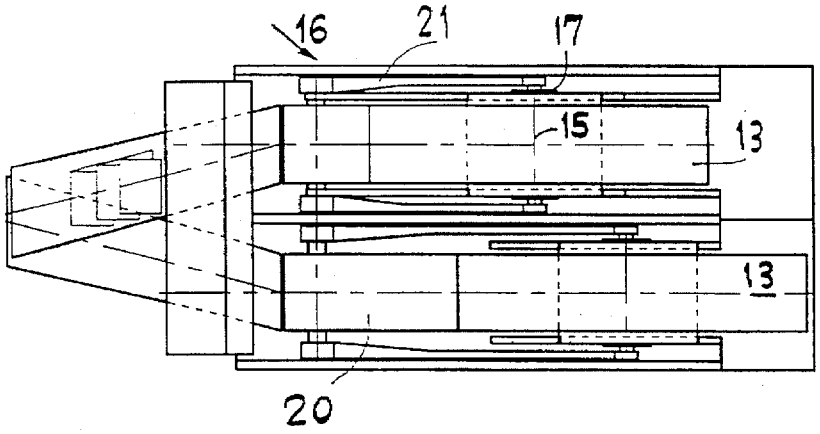
FIG. 4 is a plan view of the apparatus according to FIG. 3.

FIG. 3 and FIG. 4 show a dual unreeling station in which reels 13 formed of printed products are moved into position by a lifting truck 18 for unreeling of printed products in an apparatus 1, comprising reel stand 3, reel core 2, reeling strap mandrel 9 and clamped in reeling strap 10. First, the reeling strap mandrel 9 with the remaining reeling strap 10 is lifted out of reel stand 3 and, for unreeling, is placed into an operating position laterally of a resting position in reel stand 3, i.e., reeling strap mandrel 9 is reseated in the unreeling station.

Starting from the assumption that, for the processing or unreeling of the printed products, reel 13 must be lifted to a height which is greater than that created by the rotational freedom of apparatus 1 and that reeling strap mandrel 9 is placed into the position illustrated in FIG. 3, it is necessary for the reduction of the steepness of reeling straps 10 running off reels 13 and for the effective conveyance feeding of an exit belt 20, that reeling straps 10 be rerouted around an (elevated) tail pulley 19, as illustrated in FIG. 3. As is further shown in FIG. 3, reel 13 is lifted and lowered by lifting device 16 which is formed by swing arms 21 and which is operated by piston cylinder units 22. The free ends of the swing arms 21 laterally engage apparatus 1 and hub 7 of the reel core 2 on reel axis 15 by, for example, pin-type extensions, with hub 7 being configured as a coupling element 17 of a rotary connection.

Reel 13 is driven from the outside by a tangential drive 23. Of course, a central drive acting upon reel axis 15 would also be possible, wherein, for a uniform roll-off speed, the speed of the drive would be controlled as a function of the change in the reel diameter. At its side facing the ground, reel stand 3 is configured with a transport device which makes it possible to move apparatus 1 in the empty or reeled up condition by a lifting truck or stacker, even if a base 14 is placed underneath.

It will be understood that the above description of the present invention is susceptible to various modifications, changes and adaptations, and the same are intended to be comprehended within the meaning and range of equivalents of the appended claims.

What is claimed is:

1. An apparatus for reeling up and unreeling of flat printed products onto and from, respectively, a reel core, comprising:

a reel stand;

a reel core having a horizontal reel axis and being fixedly arranged in the reel stand to form one piece so that the reel stand and reel core can be driven together to rotate about the horizontal reel axis;

a reeling strap mandrel rotatably and detachably seated in the reel stand and having a rotational axis that is parallel with the reel axis of the reel core; and a reeling strap wound on the reeling strap mandrel and having one end connected to the reel core and a second end connected to the reeling strap mandrel, the reeling strap being unwound from the reeling strap mandrel and fed to the reel core in an undershot manner for forming a reel of layers of printed products on the reel core.

2. The apparatus according to claim 1, wherein the reel stand comprises two side walls spaced from one another by a lateral distance.

3. The apparatus according to claim 2, wherein the side walls of the reel stand form a hub of the reel core.

4. The apparatus according to claim 3, wherein the reel core is cylindrical and the reel stand ends at an upper radius of the cylindrical reel core.

5. The apparatus according to claim 2, wherein the reel stand has an end which faces a floor and is adapted for accommodating a transport device.

6. The apparatus according to claim 2, wherein the reel stand has a side facing a floor which is adapted for connection with a base.

7. The apparatus according to claim 1, further comprising suspending means for rotatably suspending the apparatus at the reel axis of the reel core.

8. The apparatus according to claim 7, wherein the suspending means comprise a rotary connection including a first coupling element connected at the reel axis.

9. The apparatus according to claim 8, wherein the suspending means includes a lifting device having a frame and the rotary connection includes a second coupling device allocated to the frame of the lifting device.

10. The apparatus according to claim 9, wherein the lifting device includes free ends and swing arms attached to the free ends which laterally engage the reel core and which can be driven by means of a pressure medium.

11. The apparatus according to claim 8, wherein the rotary connection includes a turning stop device which can be switched on.

12. The apparatus according to claim 1, wherein the reel core is adapted for accommodating a rotary drive at the reel axis.

13. The apparatus according to claim 1, further comprising means tangentially connected to the reel for rotatingly driving the reel.

14. The apparatus according to claim 1, wherein the reel stand has a lower lateral region including a bearing for receiving the reeling strap mandrel.

15. The apparatus according to claim 14, wherein the bearings comprise slot-like recesses which are open on one end.

* * * * *